US011592234B2

(12) United States Patent
Szamlewski et al.

(10) Patent No.: US 11,592,234 B2
(45) Date of Patent: Feb. 28, 2023

(54) HYDROCARBON FLUID LIQUEFACTION SYSTEM INSTALLATION AND SYSTEM THEREFOR

(71) Applicant: L'Air Liquide, Société Anonyme pour l'Etude et l'Exploitation des Procédés Georges Claude, Paris (FR)

(72) Inventors: Christophe Szamlewski, Combs la Ville (FR); Catherine Cassellari, Paris (FR); Michael Wakim, Hangzhou (CN); Thomas Morel, Champs-sur-Marne (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 38 days.

(21) Appl. No.: 17/032,942

(22) Filed: Sep. 25, 2020

(65) Prior Publication Data

US 2021/0095919 A1 Apr. 1, 2021

(51) Int. Cl.
*F25J 1/02* (2006.01)
*F25J 1/00* (2006.01)

(52) U.S. Cl.
CPC ..... *F25J 1/0214* (2013.01); *F25J 1/0022* (2013.01); *F25J 1/0259* (2013.01); *F25J 1/0262* (2013.01);
(Continued)

(58) Field of Classification Search
CPC ..... F25J 1/0214; F25J 1/0216; F25J 1/0022; F25J 1/0259; F25J 1/0262; F25J 2290/42; F25J 2290/40
See application file for complete search history.

(56) References Cited

U.S. PATENT DOCUMENTS

2006/0260357 A1* 11/2006 Gibbon ..... F25J 3/0489 62/643
2011/0265511 A1* 11/2011 Fischer ..... F25J 1/0292 62/611

(Continued)

FOREIGN PATENT DOCUMENTS

DE 10 2005 034947 10/2006
EP 3 354 866 8/2018

(Continued)

OTHER PUBLICATIONS

Flesch, E. et al., New trends in LNG process design, European GPA Meeting on Challenges in Developing LNG Projects, vol. 1, Feb. 19, 1999, 1/1-1/12.

(Continued)

*Primary Examiner* — Brian M King
(74) *Attorney, Agent, or Firm* — Elwood L. Haynes

(57) ABSTRACT

One aspect of the invention relates to a hydrocarbons fluid liquefaction system, having a first heat-exchange module having a pre-cooling exchanger having a pre-cooling circuit and a plurality of pre-cooling refrigerant circuits for pre-cooling the feed stream through the circulation of an expanded first mixed-refrigerant stream, and a second heat-exchange module having a liquefaction exchanger having a liquefaction circuit and a liquefaction refrigerant circuit for liquefying the feed stream through the circulation of an expanded second mixed-refrigerant stream, wherein each heat-exchange module has thermally insulating walls and a framework that allows the module to be transported and secured, and allows the first heat-exchange module to be stacked on top of the second heat-exchange module.

7 Claims, 3 Drawing Sheets

(52) U.S. Cl.
CPC ..... *F25J 2290/40* (2013.01); *F25J 2290/42* (2013.01)

(56) References Cited

U.S. PATENT DOCUMENTS

| | | | | |
|---|---|---|---|---|
| 2014/0053599 | A1* | 2/2014 | Byfield | F25J 1/0216 62/611 |
| 2015/0184930 | A1 | 7/2015 | Bonnissel et al. | |
| 2016/0061517 | A1* | 3/2016 | Seitter | F25J 1/0214 62/612 |
| 2019/0323769 | A1* | 10/2019 | Ducote, Jr. | F25J 1/0238 |
| 2020/0116426 | A1* | 4/2020 | Kobayashi | F25J 1/0055 |
| 2021/0372116 | A1* | 12/2021 | Hillenburg | E04B 1/34861 |

FOREIGN PATENT DOCUMENTS

| | | |
|---|---|---|
| WO | WO 2011 119697 | 9/2011 |
| WO | WO 2014 013158 | 1/2014 |
| WO | WO 2018 165712 | 9/2018 |
| WO | WO 2018 206102 | 11/2018 |

OTHER PUBLICATIONS

French Search Report for corresponding FR 1910677, dated May 25, 2020.

* cited by examiner

HYDROCARBON FLUID LIQUEFACTION SYSTEM INSTALLATION AND SYSTEM THEREFOR

CROSS REFERENCE TO RELATED APPLICATIONS

This application claims the benefit of priority under 35 U.S.C, § 119 (a) and (b) to French Patent Application No. 1910677, filed Sep. 27, 2019, the entire contents of which are incorporated herein by reference.

FIELD OF THE INVENTION

The technical field of the invention is that of the liquefaction of typical natural gases using a dual mixed-refrigerant cycle.

The present invention relates to a natural gas liquefaction system installation using a mixed-refrigerant cycle and to the system therefor.

BACKGROUND

In typical natural gas liquefaction plants using a mixed-refrigerant cycle, refrigerant streams are used to produce the refrigeration at various levels of a main heat exchanger by vaporizing against the stream of hydrocarbons to be liquefied (typically natural gas). The mixed refrigerant is typically a mixture containing hydrocarbons.

It is desirable to liquefy natural gas for a certain number of reasons, By way of example, natural gas can be stored and transported over long distances more easily in the liquid state than in the gas form, since it occupies a smaller volume for a given weight and does not need to be stored at a high pressure. For example, for a natural gas, the volume may be reduced by a factor of eight hundred compared with the natural gas.

A number of methods and systems for liquefying a stream of hydrocarbons, for example natural gas, in order to obtain liquefied natural gas (LNG) are known, particularly mixed-refrigerant liquefaction and also dual mixed-refrigerant liquefaction.

In the case of dual mixed-refrigerant liquefaction, the dual mixed-refrigerant fluid liquefaction system comprises a first mixed-refrigerant stream and a second mixed-refrigerant stream, each circulating in a closed circuit. The system further comprises a first compressor and a second compressor respectively compressing the first and second refrigerant streams, as well as a first cooler and a second cooler respectively cooling the first and second refrigerant streams. The system comprises a main heat exchanger (coiled exchanger or aluminium brazed-plate exchanger) in which the natural gas is completely liquefied and supercooled by, on the one hand, the first refrigerant stream circulating through exchanger casings and comprises at least one inlet following a step of expanding the refrigerant stream to an intermediate temperature (typically of the order of −30° C. to −100° C., for the pre-cooling and partial liquefaction of the mixture of hydrocarbons that is to be liquefied). The supercooling is then continued by the second refrigerant circulating in an exchanger casing following a step of expanding the refrigerant to the coldest temperature of the process (typically below −100° C., for example−185° C. or −165° C.), for complete supercooling and liquefaction of the mixture of hydrocarbons that is to be liquefied.

The refrigerant stream of each closed circuit circulates through at least one refrigerant circuit in which it is vaporized by exchange of energy performed by the exchanger casings between the refrigerant stream contained in the exchanger casing and the natural gas circulating through the main exchanger comprising components thereof which liquefy and cool as they sweep over the exchanger casing.

On leaving each casing of the main heat exchanger, in respect of each of the refrigerant circuits, the refrigerant is expanded, forming a vapour phase, and may contain a liquid phase for which the combination of the two phases is remixed and reintroduced into the main exchanger in order to be vaporized in each exchanger casing against the hydrocarbon-rich fraction, which liquefies.

The hydrocarbon, for example natural gas, cools and contains compounds that have different physical characteristics, some of which are grouped together as compounds referred to as heavy compounds, which liquefy between the entry temperature (ambient temperature, for example around 20° C.) and the intermediate temperature, and others of which are grouped together as light compounds, which liquefy between the intermediate temperature and the coldest temperature. The heaviest compounds will therefore vaporize at a higher temperature than the lighter compounds such as nitrogen or methane for example.

Such dual-mixture liquefaction systems impose problems with installation because of the footprint and volume that the installation within its environment requires, and because the flows of the circuits have to be strictly controlled in order to optimize the gradual change in state of the natural gas and of the refrigerant stream. In particular, for each level of vaporization of the refrigerant in each exchanger casing there will be a corresponding cooling level that allows maximum energy transfer. Installation is therefore constrained by the respective position of the pieces of equipment relative to one another according to the pressure drops associated with the various pipes and the hydraulic pressure heads. Furthermore, in environments such as on ships comprising such systems, the footprint and volume have to be adapted to what is available, because of the high cost per square metre and/or per cubic metre in such environments which necessitate endeavours to optimize cost per unit area/volume available against the costs of installing the system, the need for manufacturing and installation specific to each case implying an increase in the total cost of the installation.

There is therefore a need to propose a dual mixed-refrigerant liquefaction installation that can be adapted to suit the environment in a way that is simple and with the lowest possible cost.

SUMMARY

The invention offers a solution to the aforementioned problems by proposing a dual mixed-refrigerant liquefaction system that is modular, thus making it possible on the one hand to reduce the cost of manufacture and, on the other hand, to be able to propose a plurality of installations each comprising different relative positionings of the modules.

One aspect of the invention relates to a dual mixed-refrigerant hydrocarbon fluid liquefaction system, comprising:

1. a first heat-exchange module comprising:
   - a pre-cooling exchanger, comprising:
     - a pre-cooling circuit comprising a hydrocarbon fluid feed stream inlet, and a feed stream outlet,
     - a plurality of pre-cooling refrigerant circuits for pre-cooling the feed stream through the circulation of an expanded first mixed-refrigerant stream, the pre-cooling refrigerant circuits each comprising an inlet and an outlet, an expansion circuit per pre-cooling refrigerant circuit, comprising:

an expansion device, an inlet to receive the compressed first mixed-refrigerant stream, and an outlet, connected to the inlet of the corresponding pre-cooling refrigerant circuit in order to transfer to it the first mixed-refrigerant stream expanded by the expansion device, 2. a second heat-exchange module comprising:

a liquefaction exchanger comprising:

a liquefaction circuit comprising a hydrocarbon fluid feed stream inlet, and a feed stream outlet, a liquefaction refrigerant circuit for liquefying the feed stream through the circulation of an expanded second mixed-refrigerant stream, the liquefaction refrigerant circuit comprising an inlet and an outlet for the expanded second mixed-refrigerant stream, an expansion circuit, comprising:

an expansion device, an inlet to receive the compressed second mixed-refrigerant stream, and an outlet, coupled to the inlet of the liquefaction refrigerant circuit in order to transfer to it the mixed-refrigerant stream expanded by the expansion device, 3. wherein each heat-exchange module comprises walls for thermally insulating with respect to the outside, and comprises a framework that allows the heat-exchange module to be transported and secured, and allows the first heat-exchange module to be stacked on top of the second heat-exchange module.

By virtue of the invention, the system makes it possible to propose a flexible layout for the installation of the heat-exchange modules of the system, according to the environment.

That also makes it possible to ensure the effectiveness of the process whatever the type of hydrocarbon, notably natural gas.

That also makes it possible to guarantee construction at controlled cost, because the modules can be constructed at the factory and delivered directly to site while being able to be adapted to suit the environment of the site. Specifically, such a dual mixed-refrigerant hydrocarbon fluid liquefaction system is modular, unlike other hydrocarbon fluid liquefaction systems using a refrigerant, notably having just one mixed refrigerant.

Finally, such a heat-exchange module makes it possible to avoid the need, at the time of installation, to couple highly thermally insulated pipes in each expansion circuit and between each expansion circuit and heat exchanger, because they can already have been coupled, and/or makes it possible to improve the insulation of the refrigerant with respect to the outside because the pipes in the module are already insulated from the outside by the walls of the module.

Aside from the features that have just been set out in the previous paragraph, the dual mixed-refrigerant hydrocarbon fluid liquefaction system according to one aspect of the invention may exhibit one or more additional features from among the following, considered individually or in any technically possible combinations:

According to one embodiment, the dual mixed-refrigerant hydrocarbon fluid liquefaction system further comprises:

4. a first phase-separator module for the expanded pre-cooling mixed-refrigerant stream, comprising one phase separator per pre-cooling refrigerant circuit; each comprising:

an inlet connected to an outlet of the corresponding pre-cooling refrigerant circuit, and a gas-phase outlet to be connected to a compressor, 5. a second separator module comprising at least one phase separator for the expanded liquefaction mixed-refrigerant stream, comprising a phase separator, comprising:

an inlet connected to an outlet of the liquefaction refrigerant circuit, and a gas-phase outlet to be connected to a compressor, 6. each separator module being able to be stacked and comprising at least a framework to allow it to be transported, secured, and stacked on top of or underneath another module.

This embodiment of this system makes it possible to propose a flexible layout for the installation of the separator modules of the system, according to the environment.

According to one example, these two phase-separator modules comprise walls that are thermally insulating with respect to the outside, in order to improve efficiency.

According to one embodiment, the dual mixed-refrigerant hydrocarbon fluid liquefaction system further comprises:

7. a first pre-cooling compression module comprising a first compressor comprising an outlet coupled to the first heat-exchange module and one inlet per pre-cooling refrigerant circuit, each coupled to the outlet of the pre-cooling refrigerant circuit, 8. a second liquefaction compression module comprising a second compressor comprising an outlet coupled to the second heat-exchange module and an inlet coupled to the outlet of the liquefaction refrigerant circuit, 9. each compression module comprising a framework for transporting the module.

This system makes it possible to propose a flexible layout for the installation of the compression modules of the system, according to the environment.

According to one example of the above embodiment, the system further comprises:

10. a first cooler comprising an inlet coupled to the first pre-cooling compressor and an outlet to be coupled to the pre-cooling exchanger, 11. a second cooler comprising an inlet coupled to the second compressor and an outlet to be coupled to the liquefaction exchanger.

This allows the first and second mixed-refrigerant streams leaving the corresponding compressor to be cooled in order to reduce the transmission of heat energy by the compressed mixed-refrigerant stream entering the first heat-exchange module and/or the second heat-exchange module.

According to one example, the first cooler is mounted in the first heat-exchange module.

According to one example, the first cooler is mounted in the first compression module.

According to one example, the second cooler is mounted in the first heat-exchange module.

According to one example, the second cooler is mounted in the second heat-exchange module.

According to one example, the second cooler is mounted in the first compression module.

According to one example, the first and/or the second cooler forms another module comprising a framework.

According to one embodiment, the pre-cooling exchanger and the liquefaction exchanger each further comprise a first cooling circuit for cooling the corresponding compressed mixed-refrigerant stream, comprising:

12. an inlet to be coupled to an outlet of a compressor, and
13. one outlet per expansion circuit of the corresponding heat-exchange module, each coupled to an inlet of the corresponding expansion device.

In this way, the compressed first and second mixed-refrigerant streams are cooled at least by the pre-cooling exchanger and by the liquefaction exchanger, respectively, before being expanded, making it possible to improve the thermal efficiency of the system.

According to one embodiment, the pre-cooling exchanger further comprises a cooling circuit for cooling the compressed second mixed-refrigerant stream, comprising:

14. an inlet to receive the compressed second mixed-refrigerant stream, and
15. an outlet coupled to the inlet of the expansion circuit of the second heat-exchange module.

In this way, the compressed second mixed-refrigerant stream is cooled at least by the pre-cooling exchanger before being expanded, making it possible to improve the thermal efficiency of the system.

According to one example of this embodiment and of the previous embodiment, the outlet of the cooling circuit for cooling the compressed second mixed-refrigerant stream of the first heat-exchange module is connected to the inlet of the cooling circuit for cooling the compressed second mixed-refrigerant stream of the second heat-exchange module.

That means that the compressed second mixed-refrigerant stream can be cooled in a first temperature interval, and then the compressed second mixed-refrigerant stream can be cooled a second time in another temperature interval lower than the first temperature interval.

According to one embodiment, the first heat exchanger further comprises a phase separator comprising an inlet to receive the compressed first mixed-refrigerant stream, and an outlet coupled to the inlets of the expansion circuits, According to one example, in which the first heat exchanger further comprises a cooling circuit for cooling the first mixed-refrigerant stream, the phase separator has its outlet connected to the inlet of the cooling circuit for cooling the first mixed-refrigerant stream.

According to one embodiment, each expansion circuit comprises a separator comprising an inlet coupled to the outlet of the corresponding expansion device, a first, gas-phase, outlet and a second, liquid-phase, outlet, each coupled to the inlet of the corresponding refrigerant circuit.

For example, each expansion-device inlet is connected to an outlet of the corresponding expansion device and the two outlets are connected together and then to the inlet of the corresponding refrigerant circuit.

According to one embodiment, the pre-cooling exchanger and the liquefaction exchanger are aluminium brazed-plate exchangers. That means that the heat-exchange modules can be situated either next to one another or one on top of the other, unlike the case with coiled exchangers which have to be disposed one on top of the other.

According to one example, a separator or filter may be mounted between the outlet of the refrigerant circuits and the inlet of the liquefaction circuit in order to prevent compounds in the hydrocarbon fluid feed stream that was liquefied in the first heat-exchange module from solidifying in the liquefaction circuit. This separator or filter can be installed in the first or second heat-exchange module.

Another aspect of the invention relates to an installation of the dual mixed-refrigerant liquefaction system described hereinabove with or without the features of the various embodiments mentioned hereinabove, wherein the first heat-exchange module is mounted on top of the second heat-exchange module.

Thus, the feed stream can liquefy and circulate from the pre-cooling circuit to the liquefaction circuit under gravity because of the fact that the first heat-exchange module is stacked on top of the second.

According to one example of this embodiment, the first heat-exchange module is connected directly to the second heat-exchange module in respect of the feed stream. Assembly is thus simpler and less expensive.

According to one example of this embodiment, wherein the first heat-exchange module comprises a cooling circuit for cooling the compressed second mixed-refrigerant stream according to one example of the embodiments described hereinabove, the outlet from this cooling circuit is directly connected to the inlet of the cooling circuit of the second heat-exchange module. Assembly is thus simpler and less expensive.

According to one embodiment of the installation, wherein the dual mixed-refrigerant liquefaction system comprises the embodiment comprising the first phase-separator module and the second phase-separator module, the installation comprises the first phase-separator module mounted on top of the second separator module.

That makes it possible to reduce the footprint by stacking the two phase-separator modules.

The invention also relates to another installation of a dual mixed-refrigerant liquefaction system, wherein the dual mixed-refrigerant liquefaction system comprises the embodiment of the system comprising the first phase-separator module and the second separator module, wherein the heat-exchange modules are mounted next to one another and wherein the first phase-separator module is connected directly to the first heat-exchange module and the second phase-separator module is connected directly to the second heat-exchange module.

This installation allows the cold-part modules (heat-exchange module and separator module) to be aligned together and allows the hot part (compressor module) to be added in alignment with or perpendicular to this alignment, thus reducing the footprint and also reducing the lengths of the interconnections.

This installation may facilitate transport, allowing the complete system to be transported on a pallet or in a container, thus limiting on-site assembly.

In this installation, the speed at which the fluids circulate is higher for the same set of circumstances (same hydrocarbon to be liquefied and the same mixed-refrigerant streams for pre-cooling and for liquefaction) in order to compensate for the loss of the gravity aspect by comparison with the previous installation.

According to one embodiment of one of these installations, the installation further comprises at least one collector having the capacity of the largest volume of liquid of the dual mixed-refrigerant liquefaction system.

This collector and its capacity make it possible to avoid the creation of leak recovery ducts for each module and therefore to reduce the safety costs and simplify tracing in order to avoid the consequences of leaks and therefore of a potential fire.

According to another embodiment of one of these installations, the installation further comprises a fire detection system comprising a discharge circuit comprising valves making it possible, in the event of the detection of a fire, to open the valves in order to discharge the fluid to external collecting points situated some distance away, protecting the system from any effects caused by radiation in the event of a fire.

Such a system is beneficial when the volume of fluid is too great for a reservoir described in the previous embodiment.

The invention and the various applications thereof will be better understood from reading the following description and from studying the accompanying figures.

BRIEF DESCRIPTION OF THE FIGURES

For a further understanding of the nature and objects for the present invention, reference should be made to the following detailed description, taken in conjunction with the accompanying drawings, in which like elements are given the same or analogous reference numbers and wherein.

DETAILED DESCRIPTION OF THE PREFERRED EMBODIMENTS

Figure 1:
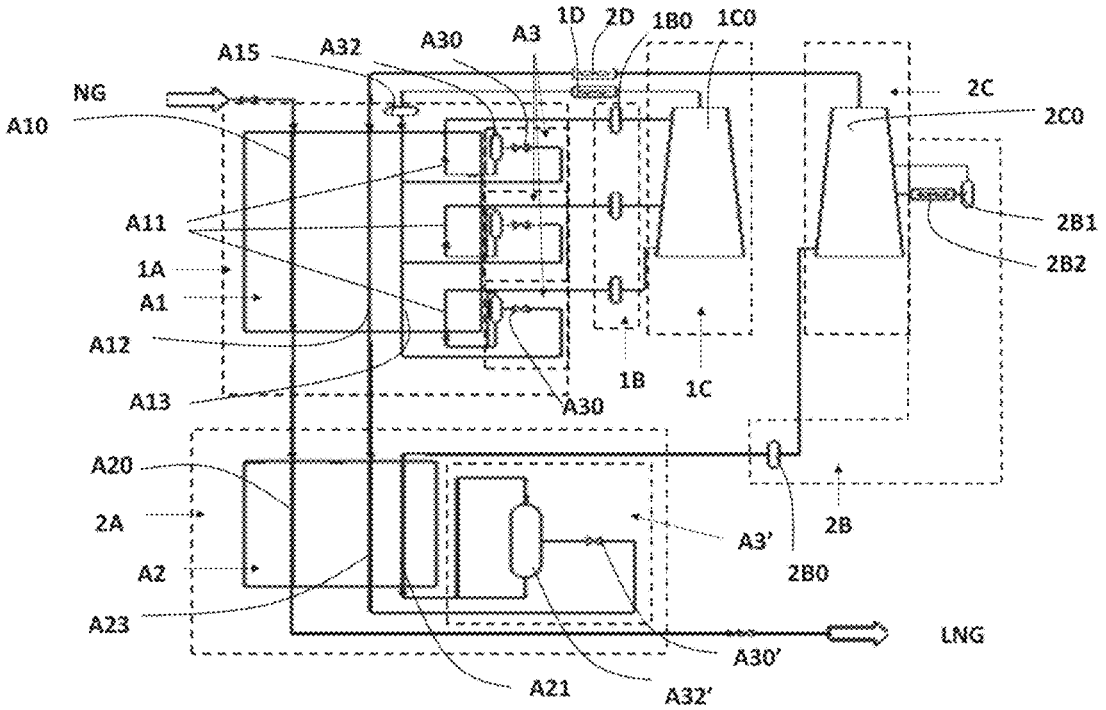
FIG. 1 is a schematic diagram of a dual mixed-refrigerant hydrocarbon fluid liquefaction system according to one example of an embodiment of the invention.

FIG. 1 is a schematic diagram of a dual mixed-refrigerant hydrocarbon fluid liquefaction system according to one example of an embodiment of the invention.

In FIG. 1, the dual mixed-refrigerant hydrocarbons fluid liquefaction system comprises a first heat-exchange module 1A comprising a heat exchanger, referred to hereinafter as the pre-cooling exchanger A1. The pre-cooling exchanger A1 comprises a pre-cooling circuit A1 for pre-cooling a hydrocarbons fluid feed stream NG, referred to hereinafter as the feed stream NG.

The feed stream NG may be a stream of natural gas, which may be pretreated, in which one or several substances, such as sulphur, carbon dioxide, water, are reduced, so as to be compatible with cryogenic temperatures, as is known in the state of the art.

The pre-cooling circuit A10 therefore comprises a feed stream inlet into which the feed stream NG is introduced at an initial temperature, and a feed stream outlet through which the feed stream is extracted at an intermediate temperature lower than the initial temperature. The feed stream NG is cooled, but not enough to be completely liquefied. Thus, hereinafter, this cooling of the feed stream NG is referred to as pre-cooled. The pre-cooling is explained hereinafter.

The dual mixed-refrigerant hydrocarbons fluid liquefaction system further comprises a second heat-exchange module 2A comprising another heat exchanger, referred to hereinafter as liquefaction exchanger A2. The liquefaction exchanger A2 comprises a liquefaction circuit A20 for liquefying the feed stream NG.

The liquefaction circuit A20 therefore comprises a feed stream inlet through which the feed stream NG is introduced at the intermediate temperature, and an outlet for a flow of liquefied hydrocarbon LNG. The flow of liquefied hydrocarbons LNG is extracted at a liquefaction temperature lower than the intermediate temperature. The flow of hydrocarbons NG is cooled enough to be completely or almost completely liquefied at the outlet. Thus, hereinafter, this cooling of the feed stream NG to a flow of liquefied hydrocarbons LNG is referred to as liquefaction.

The first heat exchanger A1 and the second heat exchanger A2 are preferably each a brazed aluminium heat exchanger, but could also be a wound coil cryogenic exchanger.

The heat exchangers are known from the prior art and may have various arrangements of their feed flows and refrigerant streams.

When the flow of liquefied, or at least partially liquefied hydrocarbons LNG is liquefied natural gas, the temperature may be around −150° C. to −160° C.

The liquefaction of the feed stream NG is performed using a circulating mixed-refrigerant stream or fluid MPR expanded in several pre-cooling refrigerant circuits A11 for pre-cooling the feed stream NG, in this instance three circuits, situated in the pre-cooling exchanger A1, and using a second circulating expanded mixed-refrigerant stream MR circulating in a liquefaction refrigerant circuit A21 situated in the liquefaction exchanger A2.

The first circulating mixed-refrigerant stream MPR and the second circulating refrigerant stream MR are preferably selected from the group comprising nitrogen, methane, ethane, ethylene, propane, propylene, butane, etc. The composition of the mixed refrigerant can vary according to the conditions and parameters desired for the pre-cooling exchanger A1 or the liquefaction exchanger A2, as is known in the prior art. The composition of the first circulating mixed-refrigerant stream MPR and of the second circulating refrigerant stream MR may be identical or different.

The first heat-exchange module 1A comprises one expansion circuit A3 per pre-cooling refrigerant circuit A11, namely, in this example, three expansion circuits A3.

Each expansion circuit A3 comprises an expansion device A30, an inlet to receive the compressed mixed-refrigerant stream and an outlet connected to the inlet of the corresponding pre-cooling refrigerant circuit A11 in order to transfer to it the mixed-refrigerant stream MPR expanded by the expansion device A30.

In this embodiment, each expansion circuit A3 further comprises a separator A32 comprising an inlet coupled to the outlet of the corresponding expansion device A30, a first, gas-phase, outlet and a second, liquid-phase, outlet, each coupled to the inlet of the corresponding pre-cooling refrigerant circuit A11.

Furthermore, in this example of this embodiment, the pre-cooling exchanger A1 further comprises a first cooling circuit A13 for the circulation of the first mixed-refrigerant stream MPR in a compressed state, comprising an inlet to receive the compressed first mixed-refrigerant stream MPR and an outlet coupled to the inlet of each expansion circuit A3.

The first heat exchanger A1 may further comprise a phase separator A15 comprising an inlet to receive the compressed first mixed-refrigerant stream MPR, and an outlet coupled to the inlets of the expansion circuits A3. According to this example, the phase separator A15 has its outlet connected to the inlet of the cooling circuit A13 for cooling the first mixed-refrigerant stream MPR.

The first circulating mixed-refrigerant stream MPR in this example therefore enters the phase separator A15 of the first heat exchanger A1 compressed, and re-emerges therefrom compressed and pre-cooled, then, in the compressed state, enters each expansion circuit A3 in which each expansion device A30 expands it, allowing the circulating first mixed-refrigerant stream MR to evaporate in each pre-cooling refrigerant circuit A11 each situated in the heat exchanger A1 in order to produce cold and thus cool the feed stream sweeping over the walls of the casings of the exchanger in which the pre-cooling refrigerant circuits A11 are situated.

The second heat-exchange module A2 also comprises an expansion circuit A3' comprising an expansion device A30', an inlet to receive the compressed second mixed-refrigerant stream MR and an outlet coupled to the inlet of the liquefaction refrigerant circuit, allowing the mixed-refrigerant stream MR expanded by the expansion device A30' to be transferred to it. In the same way as the expansion circuit A3 of the first heat-exchange module, in this embodiment, the expansion circuit A3' further comprises a separator A32' comprising an inlet coupled to the outlet of the expansion device A30', a first, gas-phase, outlet and a second, liquid-phase, outlet, each coupled to the inlet of the liquefaction refrigerant circuit A21.

Furthermore, in this embodiment, the liquefaction heat exchanger A2 further comprises a first cooling circuit A23 for the circulation of the second mixed-refrigerant stream MR in a compressed state, comprising an inlet to receive the compressed second mixed-refrigerant stream MR and an outlet coupled to the inlet of the expansion circuit A3'.

In this example of this embodiment, in order to reduce the temperature difference between the second mixed-refrigerant stream MR in a compressed state and the liquefaction exchanger A2, the pre-cooling exchanger A1 further comprises a second cooling circuit A12 for cooling the compressed second mixed-refrigerant stream MR, comprising an inlet to receive the compressed second mixed-refrigerant stream MR and an outlet coupled to the inlet of the expansion circuit A23 of the liquefaction exchanger 2A of the second heat-exchange module A2.

Each heat-exchange module 1A and 2A comprises walls for thermally insulating the corresponding heat exchanger (pre-cooling exchanger 1A and liquefaction exchanger 2A) with respect to the outside, and comprises a framework that allows the heat-exchange module 1A and 2A to be transported and secured, and potentially allows the first heat-exchange module 1A to be stacked on top of the second heat-exchange module 2A.

The framework may be made of bars made of stainless steel in order to reduce the effects of thermal diffusion. Furthermore, this framework may take the form of a container, thus forming the edge corners of a rectangular parallelepiped, also referred to as a right cuboid. Thus it is simple to transport. The framework of the first heat-exchange module 1A may further comprise feet and the framework of the second heat-exchange module 2A may comprise receiving elements that accept the feet of the first heat-exchange module 1A in order to facilitate installation if the first heat-exchange module 1A is being stacked on top of the second heat-exchange module 2A. The receiving elements may be housings or projections to guide and retain the feet of the first heat-exchange module 1A.

In this example of this embodiment, the outlet of the second cooling circuit A12 may comprise a means of connection directly to the inlet of the first cooling circuit A23 for cooling the compressed second mixed-refrigerant stream MR, so as to simplify assembly.

The system for liquefying hydrocarbon fluid using refrigerant further comprises a first phase-separator module 1B for the expanded pre-cooling mixed-refrigerant stream MPR, comprising one phase separator 1B0 per pre-cooling refrigerant circuit A13, namely, in this example, three phase separators 1B0.

The system further comprises a first pre-cooling compression module 1C comprising a first compressor 1C0 comprising an outlet coupled to the first heat-exchange module, in this instance in this example to the inlet of the phase separator A15, and three inlets (one per pre-cooling refrigerant circuit A3) each connected to a gas-phase outlet of the corresponding phase separator 1B0 of the phase-separator module 1B.

Each phase separator 1B0 comprises an inlet connected to an outlet of the corresponding pre-cooling refrigerant circuit A13 and a gas-phase outlet to be connected to the compressor 1C0 of the system.

The first mixed-refrigerant stream MPR therefore circulates in a closed pre-cooling circuit comprising a line in the compressed state from the compressor 1C0 to the pre-cooling refrigerant circuit A13, and parallel lines in the compressed state which separate the flow of the mixed-refrigerant stream MPR for each corresponding expansion device A30, in this instance three parallel lines in the compressed state, then parallel lines in the expanded state, in this instance three of them, each extending from the outlet of the corresponding expansion device A30 to the corresponding inlet of the compressor 1C0.

Each parallel line in the compressed state has a temperature distinct from the others, allowing the feed stream to be pre-cooled progressively in the pre-cooling exchanger A1.

Furthermore, in this example of this embodiment, the system comprises a first cooler 1D comprising an inlet coupled to the first pre-cooling compression module 1C, in this instance connected to the outlet of the compressor 1C0 and an outlet to be connected to the first heat-exchange module 1A, in this instance connected to the phase separator A15.

The system further comprises a second separator module 2B comprising at least one phase separator 2B0 for the expanded liquefaction mixed-refrigerant stream MR, and a second liquefaction compression module 2C comprising a second compressor 2C0 comprising an outlet coupled to the second heat-exchange module 2A, in this instance to the inlet of the first cooling circuit A23, via the second cooling circuit A12 of the first heat-exchange module 1A. The second compressor 2C0 comprises an inlet coupled to the outlet of the liquefaction refrigerant circuit A21 via the phase separator 2B0, to receive the mixed-refrigerant stream MR in the expanded state in order to compress same.

The phase separator 2B0 therefore comprises an inlet connected to an outlet of the liquefaction refrigerant circuit A21 and a gas-phase outlet to be connected to the compressor 2C0.

The second circulating mixed-refrigerant stream MR therefore circulates in a closed liquefaction circuit comprising a line for a compressed stream which therefore enters the first heat-exchange module 1A in the compressed state, and leaves same pre-cooled, then enters the first cooling circuit A23 of the second heat-exchange module 2A and leaves same cooled until it enters the expansion device of the expansion circuit A3'. The closed liquefaction circuit next comprises an expanded-stream line in which the expansion device A30' expands the stream to allow the second circulating mixed-refrigerant stream MR to evaporate in the second liquefaction refrigerant circuit A21 situated in the liquefaction exchanger A2 to produce cold, then enter the separator module 2B and finally enter the compressor 2C0.

The second separator module 2B in this example further comprises a cooler 2B1 and a separator 2B2 mounted in series. The cooler comprises an inlet connected to the second compressor 2C0 and the separator 2B2 comprises an outlet connected to an inlet of the second compressor 2C0. That allows the second mixed-refrigerant stream MR to be cooled while it is being compressed.

According to another example, the cooler 2B1 and the separator 2B2 are situated in the second compressor module 2C.

The system furthermore comprises in this example a second cooler 2D comprising an inlet coupled to the second pre-cooling compression module, in this instance connected to the outlet of the compressor 2C0 and an outlet to be coupled to the second heat-exchange module A2, in this instance connected to the second cooling circuit A12 for cooling the second mixed-refrigerant stream MR.

Each compression module 1C, 2C comprises a framework for transporting the module.

Each separator module 1B and 2B can be stackable on one another and comprises at least a framework to allow it to be transported, secured, and stacked on top of or underneath the other separator module 1B, 2B.

In this way, the system can be installed with various different layouts of the modules.

Figure 2:
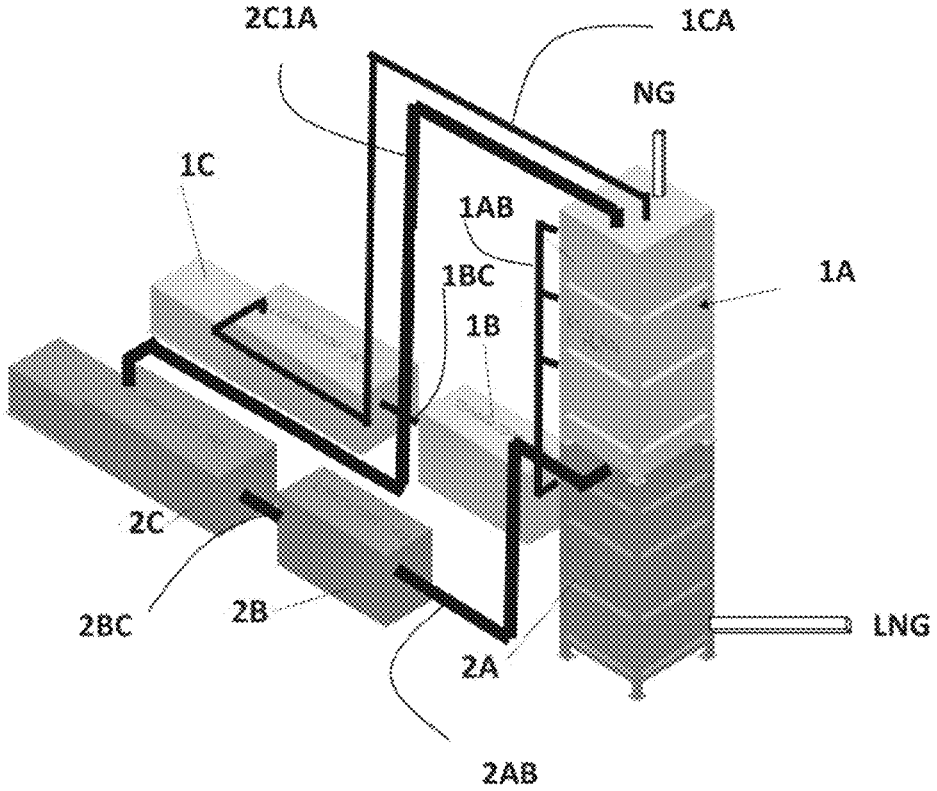
FIG. 2 is a schematic diagram depicting an installation of the dual mixed-refrigerant hydrocarbon fluid liquefaction system according to one example of an embodiment of the invention.

FIG. 2 is a schematic depiction of a dual mixed-refrigerant hydrocarbon fluid liquefaction system installation according to one example of an embodiment of the invention.

In this installation, the first heat-exchange module 1A is mounted on top of the second heat-exchange module 2A placed on the ground/floor of an environment. The tubular connections for the circuits between the first heat-exchange module 1A and the second heat-exchange module 2A may be direct connections to one another by means of tubular connections.

In this installation, the first phase-separator module 1B forms, with the first pre-cooling compression module 1C, a first alignment of pre-cooling modules, and the second phase-separator module 2B forms, with the liquefaction compression module 1C, a second alignment of liquefaction modules. The two alignments of modules are juxtaposed on the ground/floor in such a way that the space between the centres of the two alignments is aligned with the stack of the first heat-exchange module 1A on the second heat-exchange module 2*a*.

This FIG. 2 also schematically shows the pipes or pipework between each module.

Thus it may be seen that, for installing the closed pre-cooling circuit of this example of this system, all that is required is to couple a pipe 1CA to couple the first compression module 1C to the first heat-exchange module 1A, piping 1AB, in this instance having three pipes or channels, to connect the first heat-exchange module 1A to the first phase-separator module 1B, and piping 1BC, in this instance having three pipes or channels, to connect the first phase-separator module 1B to the first pre-cooling compression module 1C.

In this example, the system comprises no cooler 1D or, in another example, this is incorporated into the first compression module 1C or into the first heat-exchange module 1A.

Thus it may also be seen that, for installing the closed liquefaction circuit of this example of this system, all that is required is to couple a pipe 2C1A to couple the second compression module 2C to the first heat-exchange module 1A, to couple a pipe 2AB to connect the second heat-exchange module 2A to the second phase-separator module 2B, and piping or a pipe 2BC to connect the first phase-separator module 2B to the first pre-cooling compression module 2C.

In this example, the system comprises no cooler 2D or, in another example, this is incorporated into the second compression module 2C or into the first heat-exchange module 1A.

In this example, the piping 2BC in this instance has three pipes or channels, to connect the compressor 2C0 to the cooler 2B2 and to the separator 2B1 and to the separator 2B0. In the case of a system without a cooler 2B2 and without a separator 2B1, or in the case where the cooler 2B2 and the separator 2B1 are incorporated into the second compressor module 2C, the piping 2BC may be a single-channel pipe, Thus, the modules of the system can be coupled using just six pipes.

Figure 3:
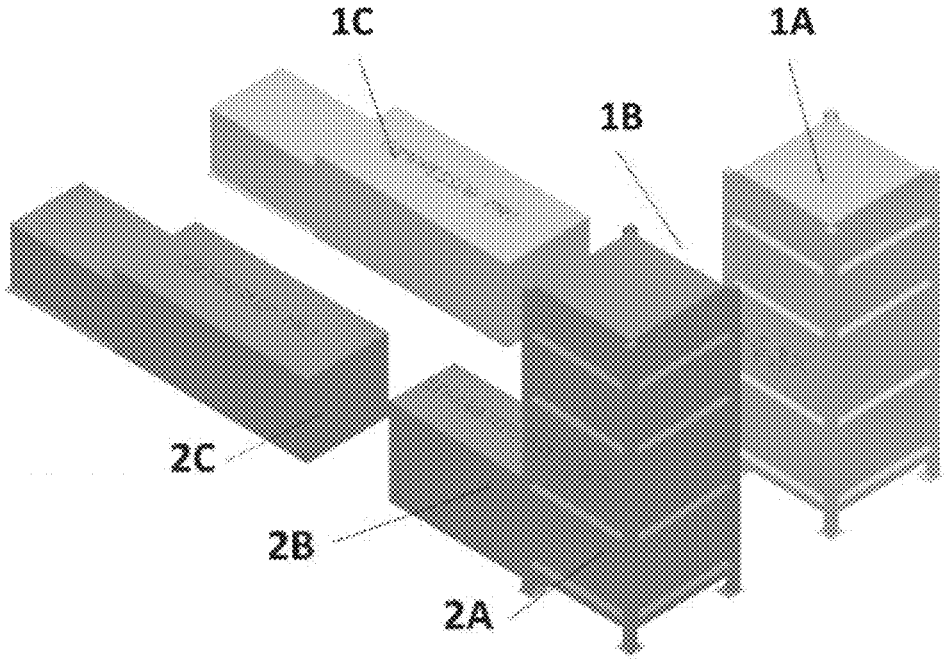
FIG. 3 is a schematic diagram depicting an installation of the dual mixed-refrigerant hydrocarbon fluid liquefaction system according to one example of an embodiment of the invention.

FIG. 3 is a schematic depiction of another dual mixed-refrigerant hydrocarbon fluid liquefaction system installation according to the preceding example, but not depicting the piping or pipes.

This installation is identical to that of FIG. 2, except for the fact that the first heat-exchange module 1A is placed on the ground/floor of the environment aligned with the first alignment and for the fact that the second heat-exchange module 2A is aligned with the second alignment.

This installation therefore further comprises a feed pipe between the two heat-exchange modules 1A, 2A and a pipe for connecting the second cooling circuit A12 to the first cooling circuit A23.

Furthermore, in this example of this installation, the first heat-exchange module 1A can be positioned against the first separator module 1B so that these can be connected to one another directly, thus omitting the piping 1AB.

Furthermore, in this example of this installation, the second heat-exchange module 2A can be positioned against the second separator module 2B so that these can be connected to one another directly, thus omitting the piping 2AB.

Figure 4:
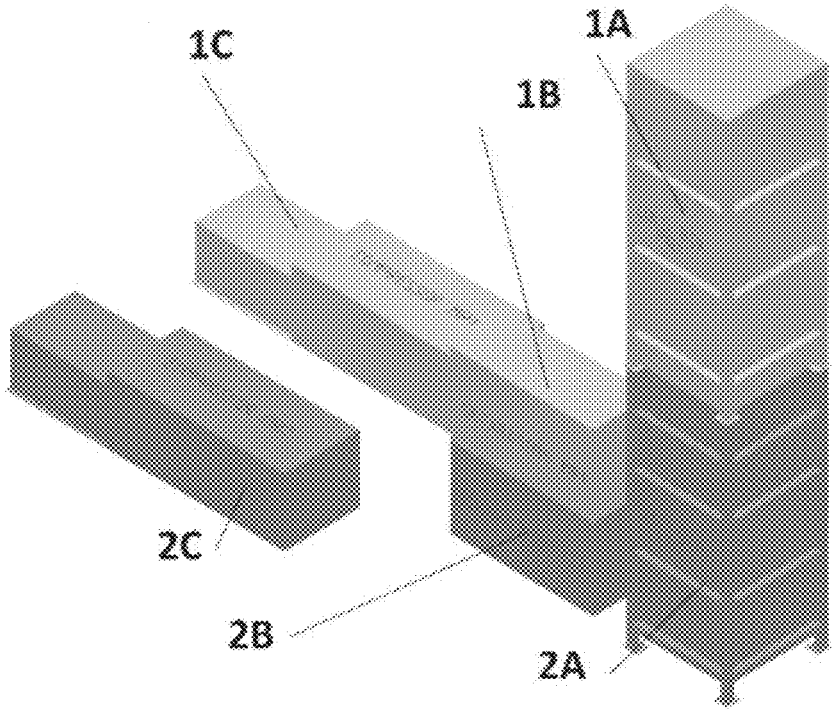
FIG. 4 is a schematic diagram depicting an installation of the dual mixed-refrigerant hydrocarbon fluid liquefaction system according to one example of an embodiment of the invention.

FIG. 4 is a schematic depiction of another dual mixed-refrigerant hydrocarbons fluid liquefaction system installation according to the preceding example, but not depicting the piping or pipes.

This installation is identical to that of FIG. 2, except for the fact that the first separator module 1B is mounted on top of the second separator module 1B, and for the fact that the stack of the separator modules 1B, 2B is aligned with the stack of the heat exchanger modules 1A, 2A.

This installation makes it possible to have the same amount of piping or number of pipes but to reduce the footprint of the installation.

FIG. 4 is a schematic depiction of another dual mixed-refrigerant hydrocarbon fluid liquefaction system installation.

according to the preceding example, but not depicting the piping or pipes.

This installation is identical to that of FIG. 2, except for the fact that the first alignment is aligned with the second alignment and for the fact that the stack of the first and second separator modules 1B, 2B is aligned between the two alignments.

Furthermore, according to one example of this installation, the second separator module 2B is positioned against the second heat-exchange module 2A. According to one example, the second separator module 2B is directly connected to the second heat-exchange module 2A thus omitting the pipe 2AB.

Figure 5:
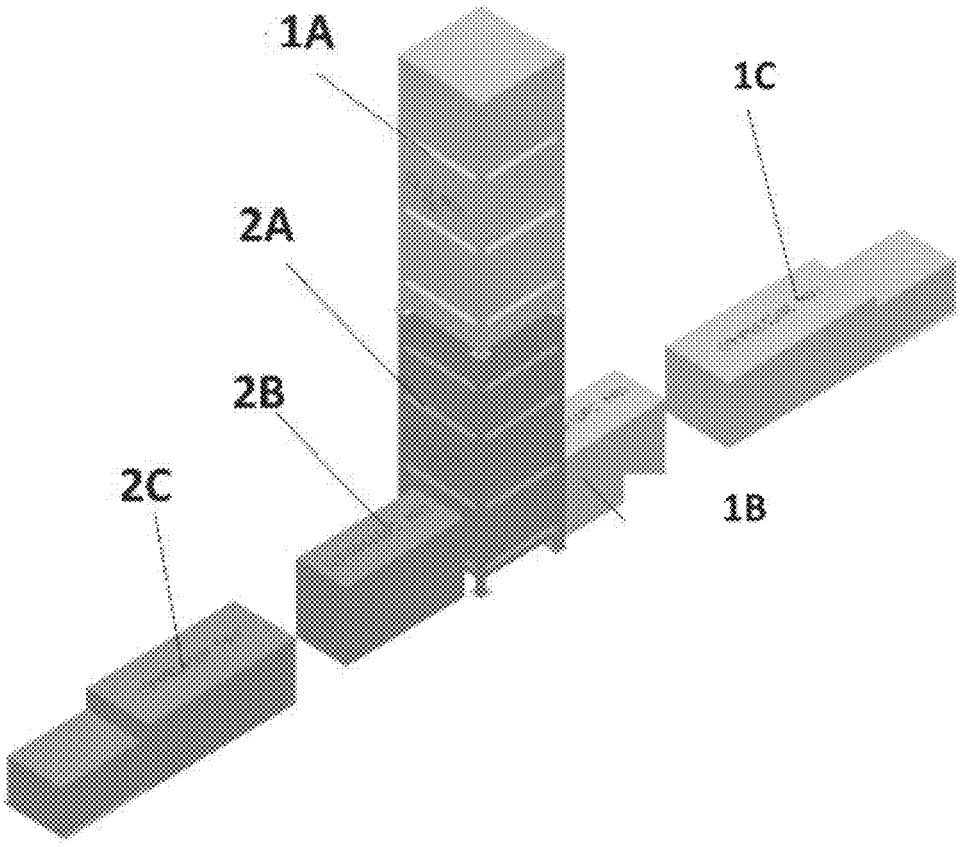
FIG. 5 is a schematic diagram depicting an installation of the dual mixed-refrigerant hydrocarbon fluid liquefaction system according to one example of an embodiment of the invention.

FIG. 5 is a schematic depiction of another dual mixed-refrigerant hydrocarbon fluid liquefaction system installation according to the preceding example, but not depicting the piping or pipes.

This installation is identical to that of FIG. 2, except for the fact that the first and second compressor modules 1C, 2C are not respectively aligned with the first and second separator modules 1B, 2B.

The first and second separator modules 1B, 2B are positioned as in the installation of FIG. 4, namely aligned with the stack of heat-exchange modules 2A, 2B.

Furthermore, according to one example of this installation, the second separator module 2B is positioned against the second heat-exchange module 2A. According to one example, the second separator module 2B is directly connected to the second heat-exchange module 2A thus omitting the pipe 2AB.

This installation makes it possible to have the same or a lesser amount of piping or number of pipes or the same or a lesser length of piping or pipes and to reduce the lengthwise footprint of the installation.

Unless specified to the contrary, the same element appearing in different figures has the same unique reference.

Each expansion circuit may comprise one or ore expansion devices in series or in parallel.

What is meant by an element is a module, or a compressor, or an expansion device, or a circuit of a module, or a cooler, or a separator.

What is meant by connections, are a tube or pipework that may be insulated or uninsulated and may comprise valves or restrictors.

What is meant by a stream is one or more fluids, that may be in liquid phase or gas phase or both, circulating through elements of the system.

What is meant by an inlet is a point at which fluid enters, therefore giving the stream a direction of circulation. In other words, an inlet of a second element is coupled downstream of an outlet of a first element.

What is meant by an outlet is a point at which fluid leaves an element, therefore giving the stream a direction of circulation. In other words, an outlet of a first element is coupled upstream of an inlet of a second element.

Coupled means coupled for the transporting of a fluid, for example an inlet coupled to an element implies that a fluid can pass from the element to the inlet either directly or via other elements.

Connected means a connection between two elements (the outlet of one element to an inlet of another element) for transporting fluid using connections, or connected directly to one another (an outlet directly coupled to an inlet of an element (without pipework)). In other words, there are no other elements between the two elements.

Secured means one element being mounted physically to another element in order to fix the one to the other.

An expanded stream means the stream downstream of an expansion circuit and upstream of a compressor.

A compressed stream means the stream upstream of an expansion circuit and downstream of a compressor.

A temperature substantially equal to another temperature means a temperature that s equal to within plus or minus 5° C.

The liquefied natural gas resulting from the method that forms the subject of the present invention can thereafter for example be transferred to a storage or transport device.

The method that forms the subject of the present invention notably affords optimization of investment expenditure. Specifically, having a modular system makes it possible to propose a plurality of layouts for the modules and thus reduce installation research costs and the cost of manufacture since each system is no longer a one-off.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A system for liquefying a hydrocarbons stream, comprising:

a first heat-exchange module comprising:

a pre-cooling exchanger, comprising:

a. a first pre-cooling circuit comprising a hydrocarbons stream feed stream inlet, and a feed stream outlet, b. a plurality of pre-cooling refrigerant circuits for pre-cooling a feed stream through the circulation of an expanded first mixed-refrigerant stream, the plurality of pre-cooling refrigerant circuits each comprising an inlet and an outlet, at least one precooling expansion circuit, comprising:

a. a precooling expansion device, b. a precooling expansion circuit inlet to receive a compressed first mixed-refrigerant stream, and c. a precooling expansion circuit outlet, connected to the inlet of the corresponding pre-cooling refrigerant circuit in order to transfer the expanded first mixed-refrigerant stream expanded by the expansion device, a second heat-exchange module comprising:

a liquefaction exchanger comprising:

a. a liquefaction circuit comprising a hydrocarbons stream feed stream inlet, and an outlet for a feed stream in the form of a flow of liquefied hydrocarbons, b. a liquefaction refrigerant circuit for liquefying the feed stream through the circulation of an expanded second mixed-refrigerant stream, the liquefaction refrigerant circuit comprising an inlet and an outlet for the expanded second mixed-refrigerant stream, a liquefaction expansion circuit, comprising:

a. a liquefaction expansion device, b. a liquefaction expansion circuit inlet to receive a compressed second mixed-refrigerant stream, and c. a liquefaction expansion outlet, connected to the inlet of the liquefaction refrigerant circuit in order to transfer the expanded second mixed-refrigerant stream expanded by the expansion device, a first phase-separator module for the expanded first mixed-refrigerant stream, comprising a first phase separator per pre-cooling refrigerant circuit; each comprising:

a first phase separator inlet connected to an outlet of the corresponding pre-cooling refrigerant circuit, and a first phase separator gas-phase outlet to be connected to a first compressor, a second phase-separator module comprising at least one second phase separator for the expanded liquefaction mixed-refrigerant stream, the at least one second phase separator comprising:

at least one second phase separator inlet connected to an outlet of the liquefaction refrigerant circuit, and an at least one second phase separator gas-phase outlet to be connected to a second compressor, and wherein each separator module can be stacked and comprises at least a framework to allow it to be transported, secured, and stacked on top of or underneath another separator module, wherein each heat-exchange module comprises walls for thermally insulating, and a framework that allows the heat-exchange module to be transported and secured, and allows the first heat-exchange module to be stacked on top of the second heat-exchange module.

2. The liquefaction system according to claim 1, further comprising:

a first pre-cooling compression module comprising a first compressor comprising an outlet coupled to the first heat-exchange module and one inlet per pre-cooling refrigerant circuit, each coupled to the outlet of the pre-cooling refrigerant circuit, a second liquefaction compression module comprising a second compressor comprising an outlet coupled to the second heat-exchange module and an inlet coupled to the outlet of the liquefaction refrigerant circuit, each compression module comprising a framework for transporting the module.

3. The liquefaction system according to claim 2, further comprising:

a first cooler comprising an inlet coupled to the first pre-cooling compressor and an outlet to be coupled to the pre-cooling exchanger, a second cooler comprising an inlet coupled to the second compressor and an outlet to be coupled to the second liquefaction exchanger.

4. The liquefaction system according to claim 1, wherein the pre-cooling exchanger and the liquefaction exchanger each further comprise a first cooling circuit for cooling the corresponding compressed mixed-refrigerant stream, comprising an inlet to be coupled to an outlet of a compressor and one outlet per expansion circuit of the corresponding heat-exchange module, each coupled to an inlet of the corresponding expansion device.

5. The liquefaction system according to claim 1, wherein the pre-cooling exchanger further comprises a second pre-cooling circuit for cooling the compressed second mixed-refrigerant stream, comprising an inlet to receive the compressed second mixed-refrigerant stream and an outlet coupled to the inlet of the expansion circuit of the second heat-exchange module.

6. The liquefaction system according to claim 1, wherein each expansion circuit comprises a phase separator comprising an inlet coupled to the outlet of the corresponding expansion device, a first, gas-phase, outlet and a second, liquid-phase, outlet, each coupled to the inlet of the corresponding pre-cooling circuit.

7. An installation of a mixed-refrigerant liquefaction system according to claim 1, wherein the first heat-exchange module is mounted on top of the second heat-exchange module.

* * * * *